US005330576A

United States Patent [19]

Clauditz, deceased

[11] Patent Number: 5,330,576

[45] Date of Patent: Jul. 19, 1994

[54] RECIRCULATING COATING LIQUID SUPPLY SYSTEM WITH VISCOSITY REGULATION

[75] Inventor: Dieter Clauditz, deceased, late of Augsburg, Fed. Rep. of Germany, by Elfrtede Rosa Clauditz, Regina Clauditz, heirs

[73] Assignee: Baldwin-Gegenheimer GmbH, Augsburg, Fed. Rep. of Germany

[21] Appl. No.: 878,446

[22] Filed: May 4, 1992

Related U.S. Application Data

[63] Continuation-in-part of Ser. No. 692,126, Apr. 26, 1991, abandoned.

[30] Foreign Application Priority Data

Apr. 26, 1990 [DE] Fed. Rep. of Germany ..... 9004745

[51] Int. Cl.[5] ..... B05C 11/00

[52] U.S. Cl. ..... 118/688; 118/602; 118/689

[58] Field of Search ..... 118/203, 602, 258, 259, 118/688, 689, 712; 101/425, 350, 364; 427/8, 444; 137/3, 4, 92, 561 R, 563; 72/54.01, 54.04; 222/52, 145

[56] References Cited

U.S. PATENT DOCUMENTS

| | | | |
|---|---|---|---|
| 2,121,045 | 6/1938 | Paynter . | |
| 2,590,538 | 3/1952 | Huck . | |
| 2,621,672 | 12/1952 | Jacobs . | |
| 2,955,459 | 10/1960 | Cihelka et al. . | |
| 3,831,616 | 8/1974 | Weyers . | |
| 3,832,886 | 9/1974 | Pliskin . | |
| 3,930,403 | 1/1976 | Cross et al. . | |
| 3,973,491 | 8/1976 | Porth et al. | 101/124 |
| 3,990,295 | 11/1976 | Renovanz . | |
| 4,130,126 | 12/1978 | Chocholaty et al. | 137/3 |
| 4,137,753 | 2/1979 | Woodle . | |
| 4,154,854 | 5/1979 | Patsko | 137/3 |
| 4,165,631 | 8/1979 | Boinet et al. . | |
| 4,270,450 | 6/1981 | Difflipp et al. | 118/203 |
| 4,350,285 | 9/1982 | Holben . | |
| 4,369,734 | 1/1983 | Preuss | 118/203 |
| 4,395,968 | 8/1983 | Wahnschaff et al. | 118/203 |
| 4,552,165 | 11/1985 | Luska . | |
| 5,197,800 | 3/1993 | Saidman et al. | 137/3 |

FOREIGN PATENT DOCUMENTS

| | | |
|---|---|---|
| 3602309 | 7/1987 | Fed. Rep. of Germany . |
| 2590842 | 6/1986 | France . |
| 59-142151 | 11/1983 | Japan . |
| 1126562 | 11/1983 | U.S.S.R. . |
| 1409341 | 9/1986 | U.S.S.R. . |
| 2142448 | 1/1985 | United Kingdom . |

*Primary Examiner*—W. Gary Jones
*Assistant Examiner*—Brenda Lamb
*Attorney, Agent, or Firm*—Natter & Natter

[57] ABSTRACT

A recirculating coating liquid supply system for continuous delivery of a supply of coating liquid to a coating apparatus includes a holding tank carrying coating liquid mixture, a main feed line having an intake at the holding tank and a discharge at an applicator trough associated with the coating apparatus. A branch of the main feed line discharges into the holding tank. The system also includes a return feed line having an intake at the applicator trough and a discharge at the holding tank. Pumps are associated with both the main feed line and the return line and a viscometer is connected to measure the viscosity of the coating liquid mixture flowing through the main feed line. Viscosity adjustments are made by infusing measured quantities of coating liquid base or coating liquid thinner into the main feed line. Switching valves are provided to divert flow for the purpose of filling the holding tank on system startup and directing all or a portion of the main feed line flow into the branch which discharges into the holding tank.

20 Claims, 8 Drawing Sheets

RECIRCULATING COATING LIQUID SUPPLY SYSTEM WITH VISCOSITY REGULATION

RELATED APPLICATIONS

This application is a continuation-in-part of application Ser. No. 07/692,126 filed Apr. 26, 1991, now abandoned.

BACKGROUND OF THE INVENTION

1. Field of the Invention

This invention relates generally to systems for coating web materials such as an apparatus for lacquering print materials in a production line of a printing plant; in particular, the invention deals with a closed loop recirculating coating liquid supply system with viscosity adjustment.

2. Related History

A typical example of a lacquering assembly suitable for integration in a production line of a printing plant was disclosed in French patent document 2,590,842. The lacquering assembly illustrated therein included a scoop roll which drew a lacquer coating mixture from an application trough and transferred the lacquer coating mixture to application rolls for continuous coating of a running web of print material.

In general the application of a lacquer coating or coatings to print material resulted in a high quality print job with optical properties otherwise unattainable in single color printing or successive overprinting. The lacquer coating imparted abrasion resistance, retarded blocking when imprinted materials were stacked and facilitated immediate further processing of imprinted materials. In order to assure uniform high quality coated print materials, lacquering assemblies were required to be furnished with a supply of lacquer coating mixture of specified rheological values which were to be constant throughout a particular job or run. Variations in properties such as viscosity were required to be quickly adjusted to meet the specifications of the job or run.

Because the lacquer coating mixture supplied to the rolls of the lacquering assembly comprised several constituents, each of which were characterized with different vaporization properties, it was necessary to monitor flow properties of the lacquer coating mixture to provide adjustment in the event such flow properties deviated from specified viscosity limits. Changes in viscosity were a function of several parameters, including surface evaporation, temperature changes and impurities introduced into the system.

Deviations from specified viscosity limits of a lacquer coating mixture resulted in impairment of the quality of the lacquer film or coating applied to the print material. Deviations in viscosity also changed the absorption characteristics of the lacquer coating mixture relative to its interaction with the various rollers of the lacquering assembly and thus impaired the operating characteristics of the lacquering assembly itself.

As previously mentioned, the lacquering assembly illustrated in French patent document 2,590,842 included an applicator trough carrying a quantity of lacquer coating mixture and a scoop roller rotating in the applicator trough. The scoop roller drew the lacquer coating mixture from the trough and coated it on the print material either directly or through an applicator roll. The lacquering assembly further operated in conjunction with a lacquer supply system which fed a lacquer mixture from a thermostatically controlled tank to the applicator trough.

The thermostatically controlled tank included a viscometer coupled to a valve which was controllable to permit a suitable quantity of thinner to be added into the tank and mixed with the lacquer mixture in the tank for the purpose of adjusting the viscosity of the coating lacquer mixture. Lacquer mixture, adjusted as to viscosity, was pumped from the tank to the applicator trough. A return line was provided from the applicator trough to the tank.

The viscometer comprised a discrete measuring device positioned in the tank from above and operated on a measuring principal common with laboratory viscometers including falling ball viscometers and rotation viscometers. Among the disadvantages inherent in such system was the fact that the viscosity measurement represented a sampling from only a specific point in the tank and the possibility of overadjustment of underadjustment of the viscosity of the lacquer coating mixture in the applicator trough was present since the viscosity of the lacquer mixture at a particular point in the tank was not necessarily that of the lacquer mixture in any other portion of the tank, in the feed lines or in the applicator trough.

In U.S. Pat. No. 4,552,165 issued to LUSKA, a system was disclosed for supplying ink and for maintaining the density of a printed color constant by detecting reflected light rays from a printed mark to provide a correction signal which was combined with a viscosity code signal obtained from a viscometer positioned at a specific location within a tank carrying an ink/solvent mixture. Such system suffered disadvantage of potential improper viscosity adjustments for the same reason as the system disclosed in French patent 2,590,842.

SUMMARY OF THE INVENTION

A recirculating closed loop coating liquid supply system for a coating assembly in a printing production line includes a holding tank carrying a mixture of coating liquid, a main feed line having an intake at the holding tank and a discharge at an applicator trough associated with the coating assembly and a return feed line having an intake at the applicator trough and a discharge at the holding tank. Pumps are associated with both the main feed line and the return line.

The system also includes a viscometer connected to measure the viscosity of the coating liquid in the main feed line, a supply of coating liquid base or concentrate and a supply of thinner. Suitable pumps are provided for introducing measured amounts of coating liquid base or thinner into the main feed line and switching valves are provided to divert flow for the purpose of permitting filling of the holding tank on start up and directing all or a portion of the main feed line flow back into the holding tank.

From the foregoing compendium, it will be appreciated that it is an aspect of the present invention to provide a recirculating coating liquid supply system of the general character described which is not subject to the disadvantages of the related history aforementioned.

It is a feature of the present invention to provide a recirculating coating liquid supply system of the general character described which facilitates economical production of high quality coated printed matter.

An aspect of the present invention is to provide a recirculating coating liquid supply system of the general character described which maintains a supply of coating liquid with predetermined viscosity specifications.

A further aspect of the present invention is to provide a recirculating coating liquid supply system of the general character described which is relatively low in cost.

An additional consideration of the present invention is to provide a recirculating coating liquid supply system of the general character described which reduces temperature induced viscosity changes.

Another feature of the present invention is to provide a recirculating coating liquid supply system of the general character described which reduces evaporation induced viscosity changes.

Yet another feature of the present invention is to provide a recirculating coating liquid supply system of the general character described wherein viscosity measurements are taken of coating liquid flowing within a conduit system to assure measurement of viscosity in the overall system rather than at a particular location.

Another aspect of the present invention is to provide a recirculating coating liquid supply system of the general character described with efficient start up and shut down cycles.

A still further feature of the present invention is to provide a recirculating coating liquid supply system of the general character described with improved reliability and which reduces the tendency for viscosity adjustment overcorrection and undercorrection.

Another consideration of the present invention is to provide a recirculating coating liquid supply system of the general character described which is well adapted for use in the production line of a printing plant.

Other features, aspects and considerations of the present invention in Dart will be obvious and in part will be pointed out hereinafter.

With these ends in view, the invention finds embodiment in certain combinations of elements, arrangements of parts and series of steps by which the aforesaid aspects, features and considerations and certain other aspects, features and considerations are attained, all with reference to the accompanying drawings and the scope of which are more particularly pointed out and indicated in the appended claims.

BRIEF DESCRIPTION OF THE DRAWINGS

In the accompanying drawings, in which is shown some of the various possible exemplary embodiments of the invention.

DESCRIPTION OF THE PREFERRED EMBODIMENTS

Figure 1:
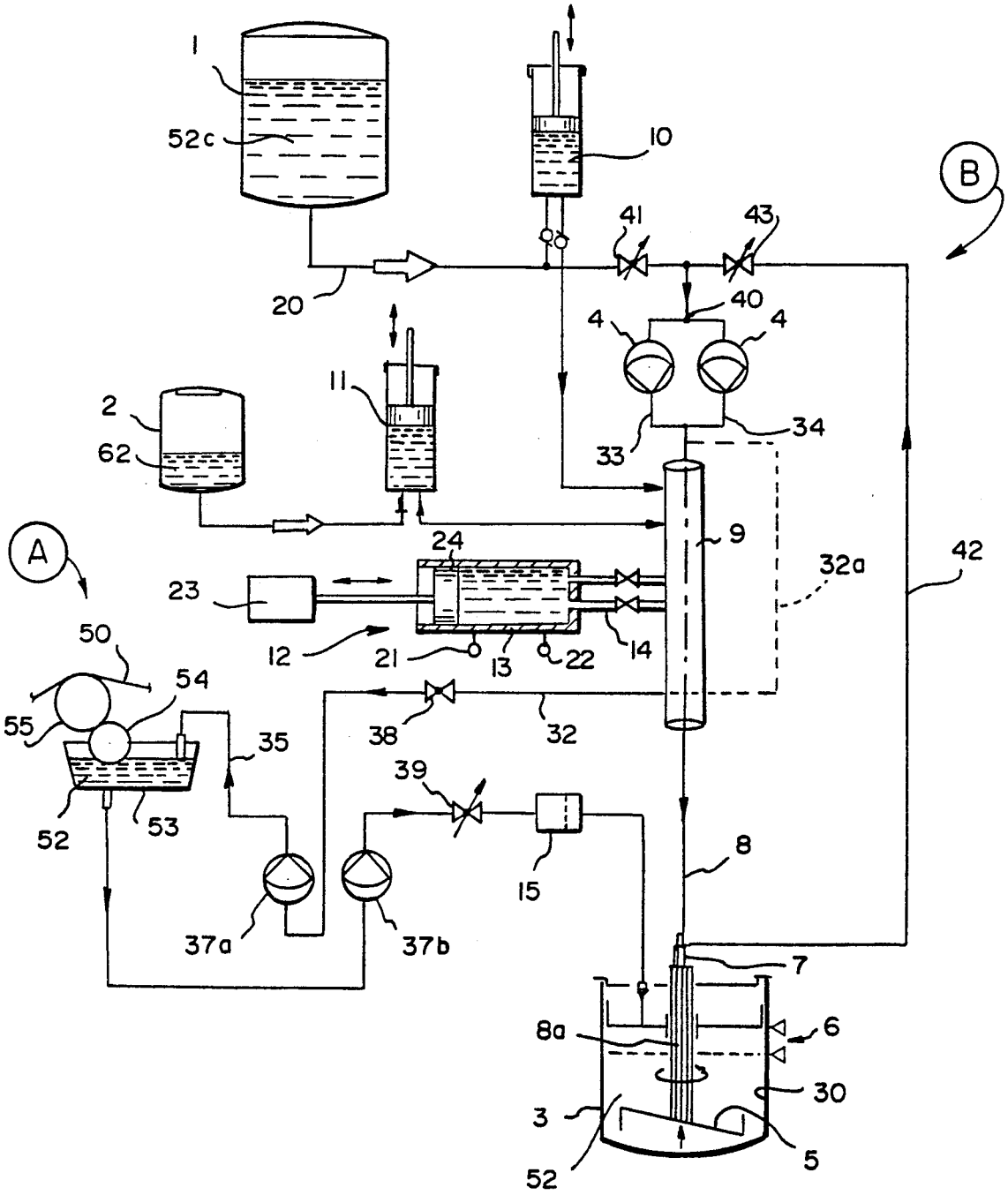
FIG. 1 is a schematized representation of a recirculating coating liquid supply system constructed in accordance with and embodying the invention and illustrating a coating assembly having an applicator trough carrying coating liquid mixture, a holding tank, a supply of coating liquid base or concentrate, a supply of thinner and a viscometer and showing a main feed line having an intake at the holding tank and a discharge at the applicator trough and a return feed line having an intake at the applicator trough and a discharge at the holding tank.

Referring now in detail to the drawings, the letter A denotes generally a coating assembly for applying a liquid coating to web material 50 such as imprinted paper stock in a production line of a printing plant. The coating assembly deposits a coating liquid mixture 52 to a face of the web material 50 prior to, after or as part of the printing process.

The coating liquid mixture 52 may comprise either a lacquer mixture formed of a lacquer base or concentrate and a thinner; alternately, the coating liquid mixture 52 may comprise sizing comprising a glaze or filler which may be made from glue, wax or clay sizing base and a suitable thinner, usually water. If the coating assembly A is a printing assembly, the coating liquid mixture 52 will comprise an ink base or concentrate and a thinner. In a typical application, the coating assembly 10 comprises a lacquering assembly used for lacquering the web 50 after it has been imprinted.

The coating assembly A includes one or more applicator rolls, such as a scoop roll 54 partially immersed in a coating liquid mixture 52 bath carried in an applicator trough 53. The scoop roll 54 draws the coating liquid mixture 52 to an applicator roll 55.

In accordance with the invention, a closed loop recirculating coating liquid supply system B constructed in accordance with the present invention is employed to furnish a continuous supply of coating liquid mixture 52 which meets the specifications of a particular print job and is maintained at substantially uniform viscosity for the duration of the coating of the web material 50, i.e. the duration of the print job.

The supply system B is configured to and continuously recirculates the coating liquid mixture in a closed environment which reduces the tendency for viscosity changes induced by evaporation and/or temperature changes and to provide for compensating adjustments in the event viscosity changes are detected.

Generally, the supply system B includes a holding tank 3 which also functions as a mixing vessel and a main feed line 42, which draws coating liquid mixture 52 from the holding tank. The main feed line includes a first branch 35 which discharges the mixture 52 at the applicator trough 53. Additionally, a second branch 8 of the main feed line discharges the mixture directly into the holding tank 3. A return line 36 draws the mixture 52 from the applicator trough and returns it to the holding tank 3.

The main feed line includes a dual pump 4 which may comprise a diaphragm pump with two chambers. A portion of the main feed line downstream of the pump includes a series connected header 9 with suitable ports for measurement of viscosity and the introduction of either coating liquid base 52*c* or coating liquid thinner 62 for adjustment of viscosity to meet the specifications of a particular application.

With reference now to FIG. 1, it will be observed that the supply system B includes a tank 1 which carries a supply of coating liquid base 52*c* and a thinner tank 2 carrying a supply of thinner 62. In the event the coating liquid mixture 52 comprises sizing, the thinner 62 will usually comprise water and the tank 2 need not be utilized; an appropriate line can be directly connected to a water supply tap.

Operation of the supply system B through a complete print job or run is divided into various stages. An initial stage is directed to the filling of the holding tank or mixing vessel 3. A quantity of coating liquid base 52*c* is drawn from the tank 1 through a line 20 and a switching valve 41 which is switched from a normally closed to an open position. From the switching valve 41, the coating liquid base 52*c* is drawn into an inlet 40 of the dual pump 4, through the dual pump 4 and through two pump outlet lines 33, 34 which are joined together and at a Y connector entrance to the header 9.

From the header 9, the coating liquid base 52*c* enters a branch or line 8 which feeds into a cylindrical vertical tube or nozzle 8*a* which extends into the holding tank or mixing vessel 3.

The holding tank 3 includes an agitator blade 5, mounted concentrically with respect to the nozzle 8*a* and which is configured to rotate as a result of the rebound of flow discharged through the nozzle 8*a*. Such configuration is of advantage when the coating liquid mixture 52 comprises a highly volatile lacquer. Since electric mixers are not employed, the requirements for explosion protection are reduced.

In addition, the holding tank 3 is configured to minimize the possibility of viscosity changes due to surface evaporation. As such, a cover 26 is provided over the holding tank 3 and a seal is assured by virtue of a collar 27 employed along the periphery of the cover 26 so that only a minor gap 28 exists between the cover 26 and an inner wall 30 of the holding tank.

A level sensor 6 is provided in the holding tank 3. Upon the initial filling of the tank 3 with coating liquid base 52*c*, the sensor detects a certain lower level at which point the initial filling of the base 52*c* is terminated and the switching valve 41 returns to its closed position. Additional capacity remains in the holding tank 3, in order to receive thinner, 62 for the purpose of producing a coating liquid mixture 52 of the specified viscosity.

The second stage of operation of the supply system B involves the introduction of coating liquid thinner 62 and mixing of the coating liquid base 52*c* and coating liquid thinner 62 to produce a coating liquid mixture 52 of the viscosity specified for the particular application. During this stage of operation, liquid in the holding tank 3 is drawn through a suction tube 7, positioned in the tank 3 with the nozzle 8*a* being coaxial to an positioned within the suction tube 7. From the tube 7, liquid enters the main line 42 and passes through a switching valve 43, now switched to its open position, and into the inlet 40 of the dual pump 4.

The liquid drawn from the holding tank 3 exits the dual pump 4 through the pump outlet lines 33, 34 and is forced through the Y connector into the header 9. From the header 9, the liquid is then returned to the holding tank 3 through the line 8 and the nozzle 8*a*.

Viscosity adjustment to specified limits is achieved by determining the viscosity of the liquid flowing through the header 9 with a viscometer 12. The viscometer 12 may comprise a measuring pump 13 having a cylinder and a piston 24 which is mounted for reciprocal movement within the cylinder and is actuated by a servo motor 23.

An intake line having a check valve is provided for the purpose of introducing liquid from the header 9 into the cylinder and a constricted outlet line or capillary tube 14, also having a check valve, is provided to feed the liquid back into the header 9. Relative viscosity of the liquid moving through the header 9 is determined, for example, by measuring the time interval which the piston 24 requires to travel a distance between two fixed cylinder reference marks, 21, 22. Such time interval represents a reference value for a certain viscosity. If the liquid drawn from the header is of a lower viscosity, the time interval for the piston to pass between the two marks 21, 22 will be reduced and if the liquid drawn from the header 9 is of higher viscosity, the time interval will be increased. This mode of operation, of course, will require that the servo motor 23 be configured to act with constant force or pressure.

Alternatively, the servo motor 23 may be configured to move the piston 24 at a constant speed and the relative viscosity measurement will be determined by measuring the force, pressure, or energy requirements to maintain the constant speed.

The viscometer 12 may also comprise a rotary pump with vanes or a diaphragm pump and the viscometer may run either continuously to obtain continuous data or intermittently at predetermined time intervals. Further, the viscometer 12 may be disposed in a bypass line or in the main line, however it is significant that the viscosity measurement by taken from liquid flowing in the lines rather than in the trough 53 or holding tank 3.

Preferably, the data obtained from the viscometer is correlated with the conventionally used measuring cup outflow times for the purpose of facilitating operator orientation to a familiar measurement scale.

Upon initial filling of the holding tank 3, the liquid flowing through the header 9 will comprise only coating liquid base 52*c* which, in all likelihood, will have a viscosity too high for a particular specified application. The correct viscosity is achieved by supplying an appropriate quantity of thinner, 62 carried in the tank 2. The thinner 62 is drawn from the tank 2 through a feed line, by a thinner dosing pump 11 having an intake check valve and an outlet check valve. Return stroke of the dosing pump 11 forces a measured quantity of thinner into the header 9 wherein it is mixed with the liquid flowing through the header 9 and is discharged through the branch 8 and nozzle 8*a* into the holding tank 3 for further mixing by the agitator blade 5.

In the event the viscometer 12 produces a viscosity measurement indicating that the liquid flowing through the header 9 is too thin, coating liquid base 52*c* is drawn from the tank 1 through the line 20 by a dosing pump 10 having a check valve at its inlet and outlet. The return stroke of a piston of the dosing pump 10 discharges an appropriate quantity of coating liquid base 52*c* through a line and into the header 9. Alternatively, the valve 41 may comprise a multiple way proportional valve and coating liquid base 52*c* may be drawn from the tank 1 through the main pump 4.

Once the desired viscosity of the coating liquid mixture 52 is achieved, a switching valve 38 is opened and the coating liquid mixture 52 is fed to the applicator trough 53 through a line 32, which is connected to an exit port of the header 9. Alternately, the line 32 may bypass the header 9 and be connected to the main line adjacent the Y connector inlet of the header as shown by a dashed line 32*a*.

The applicator through inlet line 32 includes, in addition to the switching valve 38, a pump 37*a*. The pump 37*a* discharges into the applicator trough 53 through a line 35. For the purpose of preventing surface evaporation, the applicator trough 53 includes a suitable cover.

A return line 36 draws coating liquid mixture 52 from the applicator trough 53 through a pump 37*b*. The pumps 37*a*, 37*b* may comprise sections of a double diaphragm pump. After being discharged from the pump 37*b*, the coating liquid mixture 52 passes through a switching valve 39, and a filter 15 which removes impurities introduced through the rolls 54, 55, and discharges into the holding tank 3. The switching valves 38 and 39 are preferably ballcock valves.

During operation of the coating assembly A, coating liquid mixture 52 continuously circulates from the holding tank 3 into the applicator trough 53 through the main line, 42, 32, 35 and is returned to the holding tank 3 through the line 36. A portion of the flow through the line 42 is directed in the line 8 for discharge in the holding tank 3. The main line and the return line continuously operate during operation of the coating assembly A. Any depletion of coating liquid will be sensed by the sensor 6 and required quantities of both coating liquid base 52*c* and thinner 62 will be added.

In the event the viscometer 12 detects that the viscosity of the coating liquid mixture passing through the header 9 is not within the permitted viscosity range of a particular application, suitable controls will be actuated (either manually by an operator or through an automatic processor control system) to cause the required quantity of coating liquid base 52*c* or thinner 62 to be forced into the header 9 and mixed with the liquid flowing through the header, both within the header 9 itself, within the holding tank 3, within the main line 42, 32, 35 and in the return line 36.

The main pump 4 and the pumps 37*a*, 37*b* can be pneumatically operated. In such event, a suitable supply of compressed air with a conventional oil and water separator will be utilized. It should be appreciated that because the main and return lines of the coating liquid supply system B are relatively short, and the system overall maintains a compact design and is closed to external environmental exposure, favorable temperature distribution results since temperature gradients due to air flow and air to heat transfer are eliminated. Further, because the system of the present invention is essentially sealed, viscosity changing impurities which would have a tendency to infiltrate in other systems are avoided.

Referring now to FIGS. 2 through 8 wherein an alternate embodiment of the invention is illustrated, it should be noted that such embodiment is configured to provide for automated or semiautomated cycling from initial start up through cleaning and purging at the end of a print run.

Figure 2:
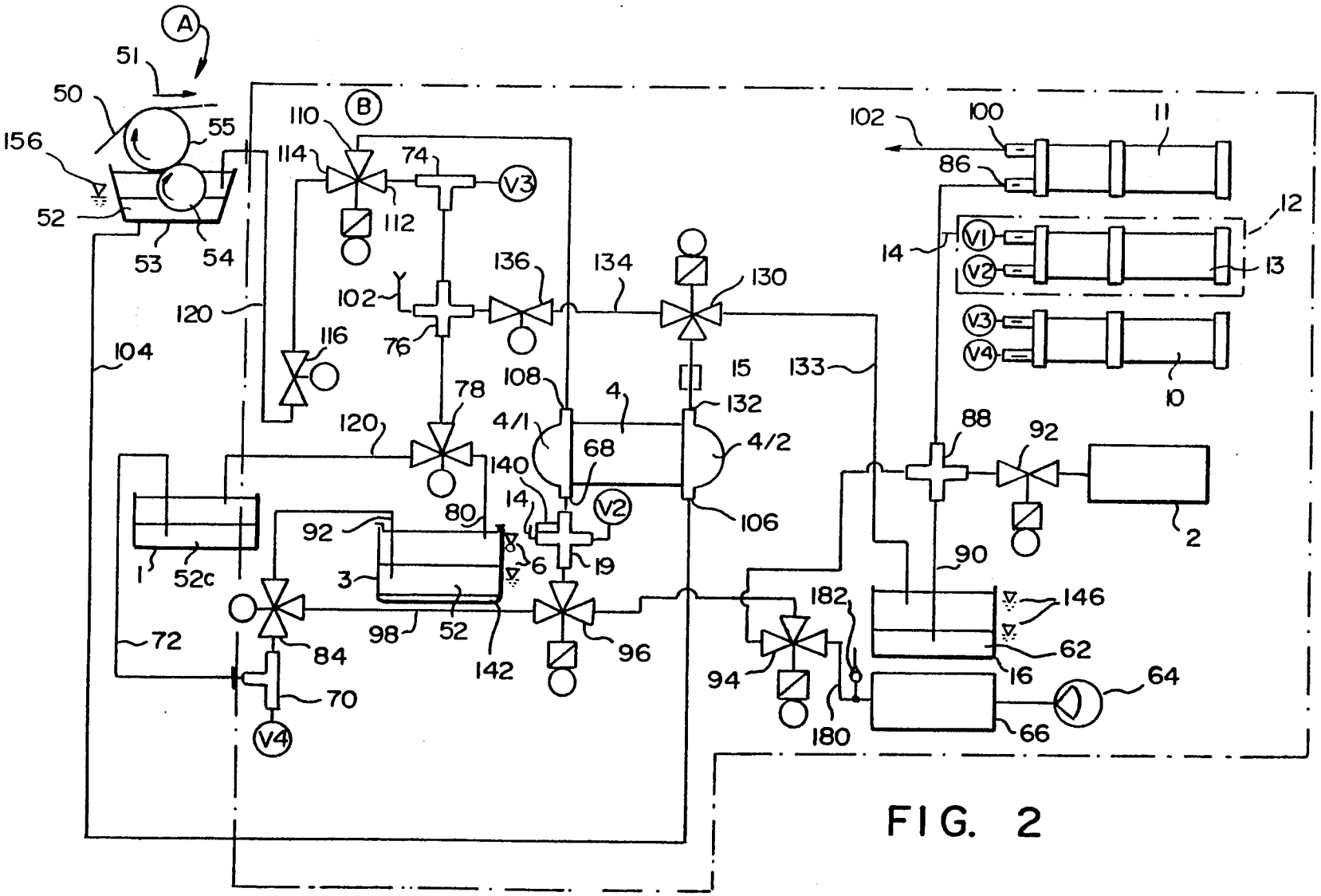
FIG. 2 is a schematized representation of a further embodiment of the invention wherein conduits are provided for cleaning the system with thinner and for purging with compressed air.

It is possible for the coating liquid supply system B in the embodiment of FIG. 2 to utilize a coating liquid mixture which is provided to the supply system B in finished, desired consistency, i.e. premixed. During operation, the viscosity of the coating liquid mixture is monitored and necessary adjustments to maintain viscosity within specified limits are made. Alternately, the supply system B can produce coating liquid mixture 52 of desired finished consistency from a coating liquid base 52*c* and thinner 62. Coating liquid base 52*c* is carried in a suitable tank 1 and thinner 62 is carried in a flush vessel 16 as well as a thinner tank 2.

As with the prior embodiment, the coating liquid supply system B of the FIG. 2 embodiment operates in various stages. In an initial stage, the coating liquid is formulated from coating liquid base or concentrate 52*c* and thinner 62 and mixed (in the event coating liquid mixture has not been retained from a prior run). In a next stage, coating liquid mixture of specified consistency is supplied by the system B to the coating assembly A in a closed loop recirculating path. Subsequent stages include stages of evacuation, cleaning and air purging.

In the mixing stage, the coating liquid mixture 52, carried in a holding tank 3, is circulated out of the holding tank 3 and back into the holding tank to achieve thorough mixing prior to and during a coating operation.

After the coating liquid mixture 52 has been thoroughly mixed and is within the specified viscosity limits, the coating liquid supply system B switches automatically or via manual controls to supply an applicator trough 53 with an appropriate level of coating liquid. Excess coating liquid carried in the applicator trough 53 is drawn through a return line and returned to the holding tank 3. From the holding tank 3, coating liquid mixture 52 is drawn through a main line by a main pump 4 with the main line discharging into the applicator trough 53. On the upstream side of the pump, a portion coating liquid mixture 52 flow is drawn from the main line into a viscometer 12 and is discharged from the viscometer 12 back into the main line. As previously mentioned, in lieu of utilizing a measuring pump 13, any conventional viscometer may be utilized.

Since the coating liquid supply system B continuously recirculates coating liquid, any viscometric measurement ascertained at the viscometer 12 will be representative of the viscosity of the coating liquid mixture being transported to the applicator trough 53.

The coating liquid is thinned or thickened if necessary, by the introduction of thinner 62, drawn from the flush vessel 16 and/or the thinner tank 2 or coating liquid base 52*c*, drawn from the tank 1 into the main line downstream of the pump and into a branch of the main line which discharges into the holding tank a sufficient distance from the holding tank 3 to assure homogeneous blending within the line itself.

The levels of coating liquid mixture in the holding tank 3 the applicator trough 53 and the level of thinner 62 in the flush vessel 16 is each detected by an appropriate sensor or level regulator, 6, 56 and 146 respectively.

Upon completion of the coating operation, the applicator trough 53 is emptied and thereafter flushed with thinner 62. Thinner 62 is then pumped back into the flush vessel 16 for reuse.

In order to avoid surfaces of coating liquid mixture in contact with the atmosphere, the holding tank 3 is provided with a cover 26, the applicator trough 53 and the flush vessel 16 are covered and the tanks 1 and 2 are sealed.

The main pump 4, as with the pump of the prior embodiment, is preferably a diaphragm pump with two separate delivery chambers 4/1 and 4/2. The pump 4 is operated pneumatically. A coating liquid base dosing pump 10, a thinner dosing pump 11 and the measuring pump 13 of the viscometer 12 are valve controlled with the timing of the pumps 10, 11 and 13 as required for suitable operation, preferably controlled through the use of a processor.

The sensors 6, 56 and 146 can be of conventional configuration and may be coupled to the processor. Appropriate switching, display and testing controls are provided on a console. The actual viscosity value as measured at the viscometer 12 appears on a display, preferably coordinated to viscosity measuring cup parameters.

As with the viscometer 12 of the prior embodiment, there are several manners in which a viscosity measurement value can be obtained. For example, a relative viscosity value can be determined by measuring the pump pressure required for a piston stroke or the pump energy required; alternately, a relative viscosity measurement can be obtained by measuring the time of piston travel over a certain distance when the delivery pressure is constant or, alternatively, by measuring the distance of piston travel in a given time when delivery pressure is maintained constant.

It should be appreciated that the mode of operation of the viscometer 12 need not be constricted to the foregoing nor is a restricted flow path required in order to provide an accurate relative viscometric measurement.

Referring now in greater detail to the drawings, it should be noted that the coating assembly A coats a web 50 of imprint material which is moved continuously in a direction of an arrow 51. The web 50 may comprise a continuous web of paper or cloth, and the coating liquid may comprise paint, lacquer, sizing, or printing fluid such as ink. If the web 50 has been imprinted with pictures or data, the coating liquid mixture 52 preferably comprises a transparent lacquer.

The coating assembly A includes a scoop roll 54 which rotates in coating liquid 52 carried in the applicator trough 53. Coating liquid is removed by the scoop roll 54 and transferred to an applicator roll 55. A suitable level control device e.g. the sensor 56, monitors the level of coating liquid mixture in the applicator trough.

The supply system B includes the tank 1 which carries coating liquid base **52*c* having a substantially higher viscosity than the coating liquid mixture 52 in the applicator trough 53. Measured quantities of thinner 62 are added to the coating liquid mixture 52** for viscosity adjustment.

For the purpose of cleaning the various conduits of the supply system B, thinner 62 is flushed through the various conduits and collected in a flush vessel 16. Additionally, the various conduits may be purged with compressed air from a tank 66.

After the start up of the system, coating liquid base or concentrate in the tank 1 is introduced not through the main pump 4 but through the dosing pump 10 and mixed in the conduit system with the coating liquid mixture 52 already circulating and the mixture is then deposited into the holding tank. Similarly, thinner 62 is introduced into the conduit system by the dosing pump 11, and mixed, within the conduit system, with the coating liquid mixture already in the line prior to being deposited in the holding tank. The main pump 4 draws coating liquid mixture 52 out of the holding tank and into the applicator trough 53 and/or back into the holding tank.

The viscosity of the coating liquid mixture may be different in the applicator trough 53 and holding tank 3 and, in the case of an inhomogeneous mixture, it may be inhomogeneous within the applicator trough and/or holding tank. The most homogeneous viscosity distribution of coating liquid mixture is not in the holding tank or applicator trough, but within the conduits or lines of the closed loop supply system B. In the closed loop supply system, viscosity variation due to evaporation cannot occur.

Figure 3:
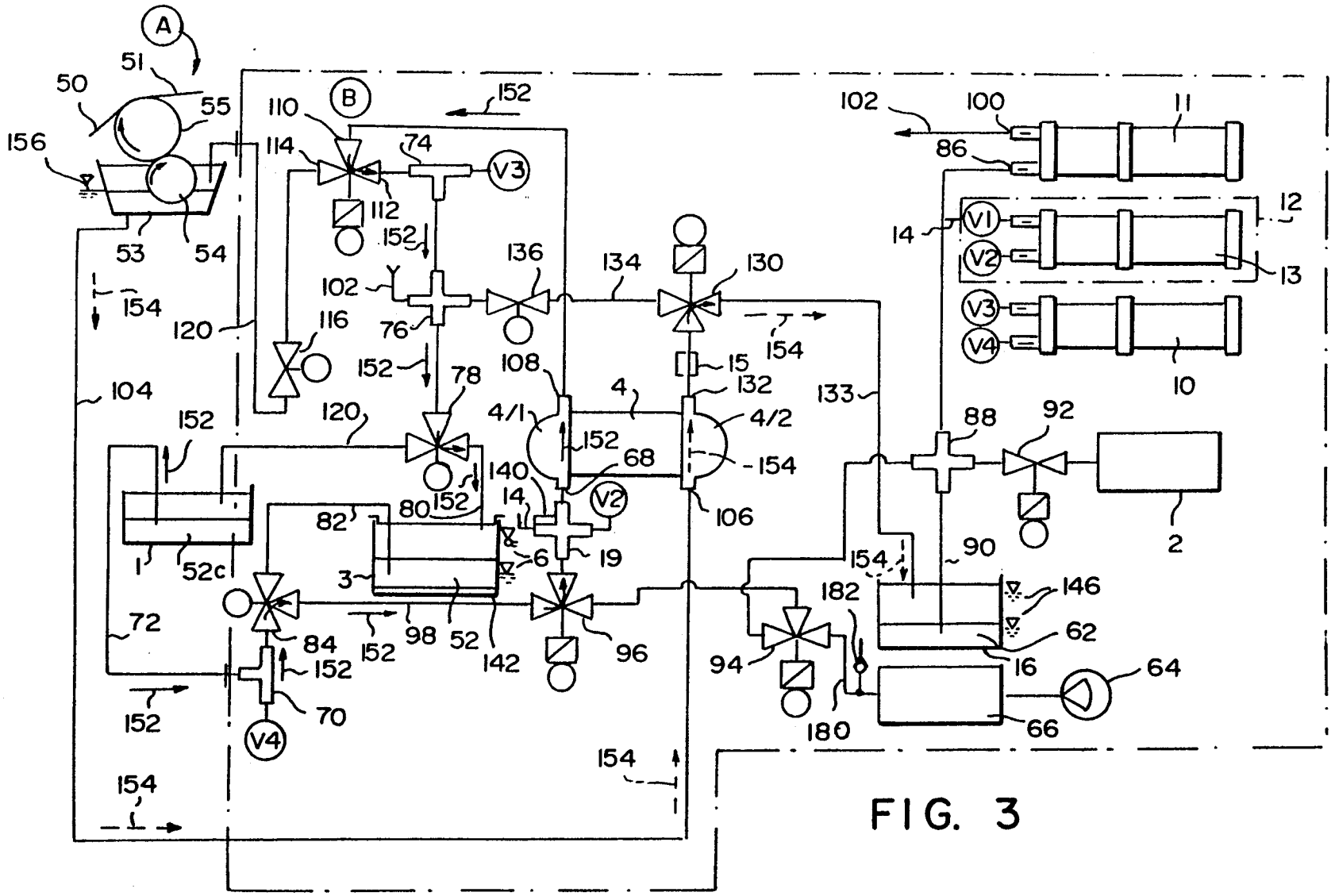
FIG. 3 is a schematized representation of the embodiment illustrated in FIG. 2 but showing liquid flow and valve orientation during an initialization stage of start up.

Referring now in detail to FIG. 3 wherein liquid flow and valve orientation are illustrated in an initial stage of start up, it should be noted that the applicator trough 53 and the holding tank 3 will be empty. When the system is initialized, a pump 4/1 of the main pump 4 draws a supply of coating liquid base **52*c* from the tank 1 along a path denoted by a plurality of arrows 152 and through a suction line 72, a T coupling 70, a switching valve 84, a line 98, a further switching valve 96, a cross coupling 19, a pump inlet line 68, a pump outlet line 108, a further switching valve 110, a T coupling 74, a further cross coupling 76, and a further switching valve 78 to a branch line 80 which discharges the base concentrate 52*c* into the holding tank 3. It should be noted that all of the switching valves are switched to permit flow passage in the direction of the arrows indicated in FIG. 3** on the respective switching valves.

The holding tank 3 continues to fill until the sensor 6 detects that the fluid level has reached a certain predetermined lower level. If the applicator trough 53 contains residue of thinner 62 from a previous operating cycle, the thinner 62 is pumped from the applicator trough into the flush vessel 16 along a flow path indicated by a plurality of dashed arrows 154 through a suction line 104, an intake 106 of the pump 4/2, a filter 15, a switching valve 130, and a discharge line 133 into the flush vessel 16. The two pump sections 4/1 and 4/2 of the main pump 4 are driven simultaneously.

Figure 4:
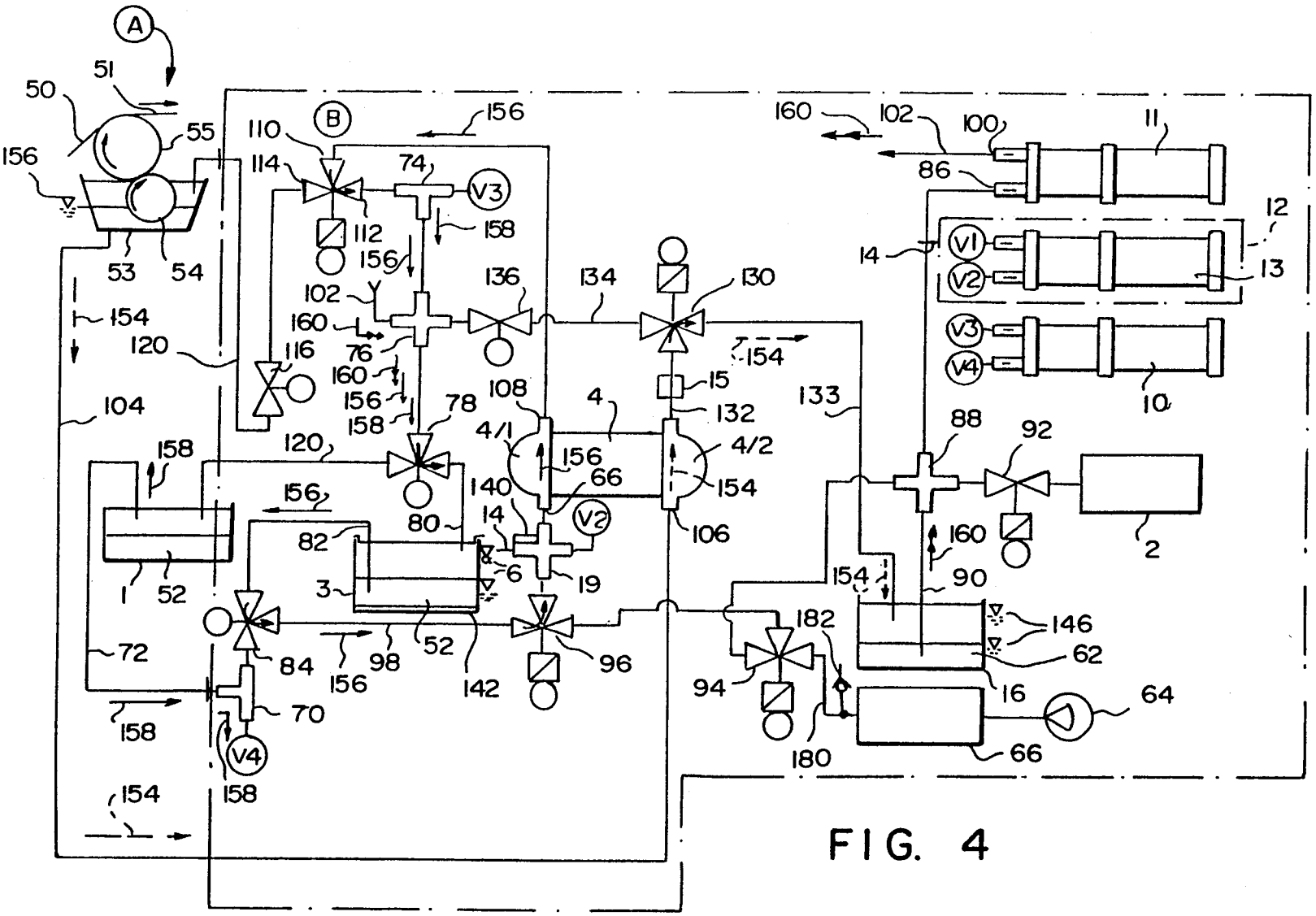
FIG. 4 is a schematized representation of the embodiment illustrated in FIG. 2 but showing liquid flow and valve orientation during a stage of start up wherein the constituents of the coating liquid are mixed prior to filling the applicator trough.

After the holding tank 3 has been filled to its specified level with coating liquid concentrate and after the applicator trough 53 has been evacuated of thinner, the supply system B enters a next stage of operation, with fluid flow and valve orientation depicted in FIG. 4 wherein the coating liquid mixture 52 is mixed by recirculation of coating fluid mixture out of and into the holding tank.

Pursuant to the invention, the coating liquid mixture 52 is mixed, not in the holding tank 3 but in the closed conduit system. Recirculating coating liquid mixture flows from the holding tank 3 through the various lines of the conduit system in a path indicated by a group of the arrows 166 through a suction line 82, a switching valve 84, the line 98, a switching valve 96, through the cross coupling 19 and into the inlet 68 of the pump 4/1, through a pump discharge outlet line 108, through the switching valve 110, and into the T coupling 74. From the T coupling 74, the coating liquid mixture flows into the cross coupling 76, thence into the switching valve 78 and then through the discharge line 80, back into the holding tank 3.

Viscosity measurements of the coating liquid mixture are measured not in any of the vessels or tanks wherein quantities of coating liquid mixture are carried, but in the conduit lines and preferably, in the flow path from the holding tank 3 prior to discharge. Accordingly, relative viscosity measurements are taken with samplings of coating liquid mixture being drawn from the cross coupling 19 on the upstream side of the pump 4/1 and into an inlet V2 of the viscometer measuring pump 13 and back into the cross coupling 19 through a constricted flow capillary line 14 extending from an outlet V1 of the measuring pump 13. As previously mentioned, the viscometer 12 need not include a measuring pump or make viscosity determinations based upon a constricted flow capillary line.

In the event additional thinner 62 is required, it is drawn by the thinner dosing pump 11 along a flow path indicated by a plurality of double headed arrows 160 from the flush vessel 16 through a suction line 90, a cross coupling 88 and a thinner pump intake 86. Alternately, thinner 62 can be supplied from the tank 2 through a switching valve 92, and the cross coupling 88 into the intake 86. Thinner 62 is discharged from the pump 11 along the flow path indicated by the arrows 160 through a pump outlet 100, a line 102 and into the cross coupling 76 on the upstream side of the pump 4/1. The thinner 62 is mixed in the conduit system with the coating liquid mixture 52 flowing along the path 158.

In the event coating liquid base 52*c* is required, an outlet V3 of the coating liquid base dosing pump 10 draws coating liquid base from the tank 1 along a flow path 158 through the suction line 72 and the T coupling 70 into an inlet V4 of the pump 10. The pump 10 discharges the coating liquid base 52*c* into the T coupling 74 on the upstream side of the pump 4/1. The base 52*c* then mixes with the coating liquid mixture 52 running through a line 80 running into the holding tank 3.

The locations where the coating liquid base and thinner are introduced into the conduit system are a relatively long distance from the holding tank 3 and the adjusting components are fed in a slow controlled fashion so that mixing of the components with one another and with the coating liquid mixture 52 flowing the conduit system takes place within the conduit system including the discharge line 80 and does not necessarily occur in the holding tank 3.

Figure 5:
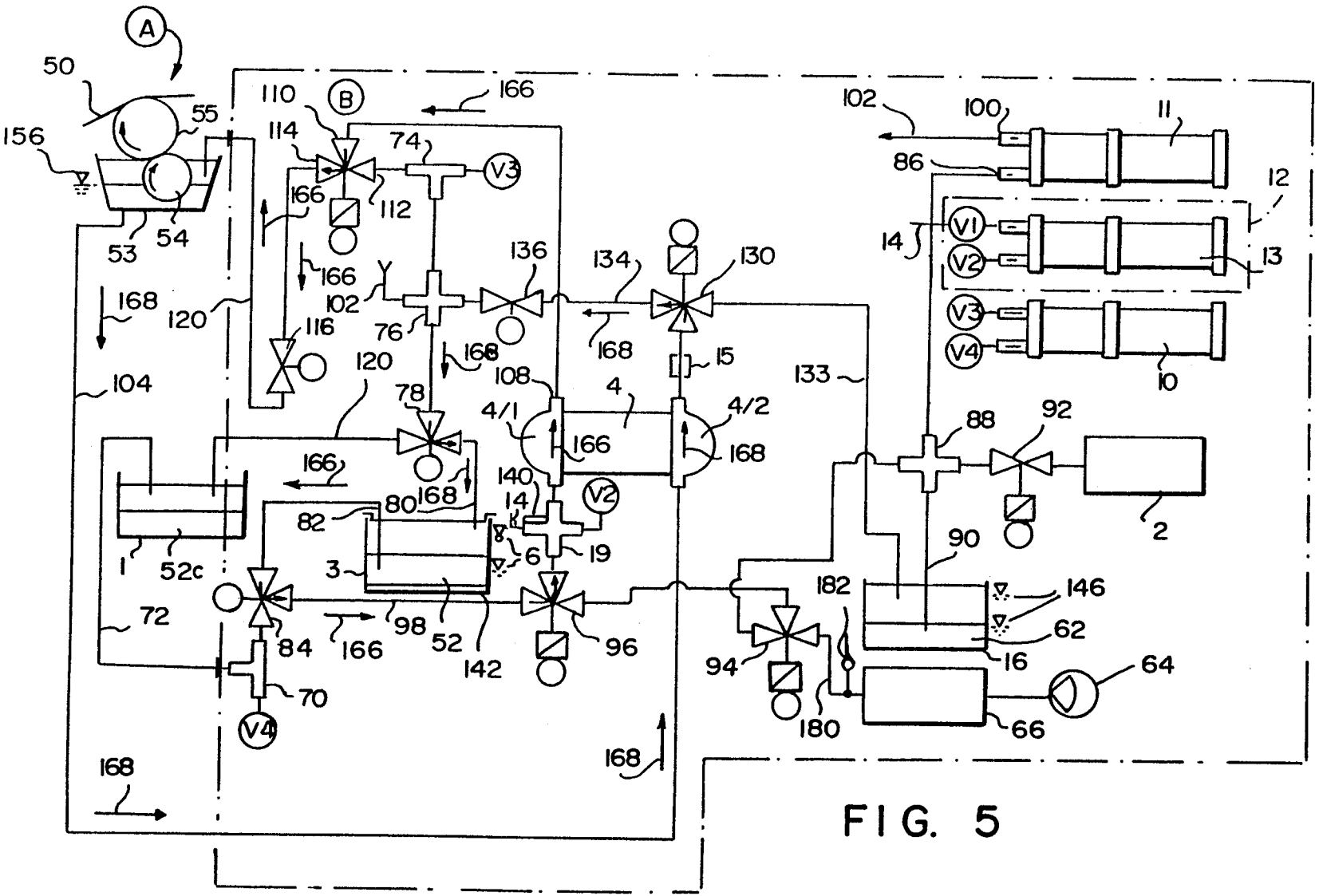
FIG. 5 is a schematized representation of the embodiment of the invention illustrated in FIG. 2 but showing liquid flow and valve orientation during a stage of operation wherein the coating assembly is operational and print material is being coated.

After thorough mixing and viscosity adjustment of the coating liquid mixture 52, the applicator trough is filled to a specified level and the coating assembly A may commence operation. The operation of the liquid supply system B continues to the next successive stage which is illustrated in FIG. 5.

Coating liquid mixture 52 is drawn from the holding tank 3 along a flow path indicated by a plurality of arrows 166, through the suction line 82, the switching valve 84, the line 98, the switching valve 96, the cross coupling 19 and into the inlet 68 of the pump 4/1. From the outlet of the pump 4/1, coating liquid mixture flows through the line 108, into the switching valve 110 which is switched to direct fluid flow through an outlet 114, a further switching valve 116 and a discharge line 120 into the applicator trough 53.

Upon the sensor 56 detecting that the level of coating liquid mixture 52 in the applicator trough 53 is appropriate, coating liquid mixture level is maintained by drawing mixture from the applicator trough 53 along a path denoted by a plurality of arrows 168 and through the suction line 104, into the inlet 106 of the pump 4/2 through a line 132, the filter 15 and the switching valve 130, through the line 134 the switching valve 136 and into the cross coupling 76. From the cross coupling 76, fluid flow continues through the switching valve 78 and to the discharge line 80 for discharge into the holding tank 3.

Such main line fluid flow along the path denoted by the arrows 166 and return fluid flow along the path denoted by the arrows 168 continues during the duration of the operation of the coating assembly A while, at the same time, either continuous or intermittent viscosity measurements are taken in the main line at the cross coupling 19 and appropriate viscosity corrections are made with the introduction of coating liquid base or thinner as previously mentioned.

Because the viscosity of the coating liquid mixture 52 is a function of temperature, the cross coupling 19 and the holding tank 3 may each include a temperature sensor and an automatically controlled temperature adjustment apparatus such as a heating and/or cooling device, 140, 142, respectively.

As the supply of coating liquid mixture becomes depleted during the coating process, reduced levels of coating liquid in the holding tank are detected by the sensor 6 and additional quantities of coating liquid base and thinner, if appropriate, are added.

Figure 6:
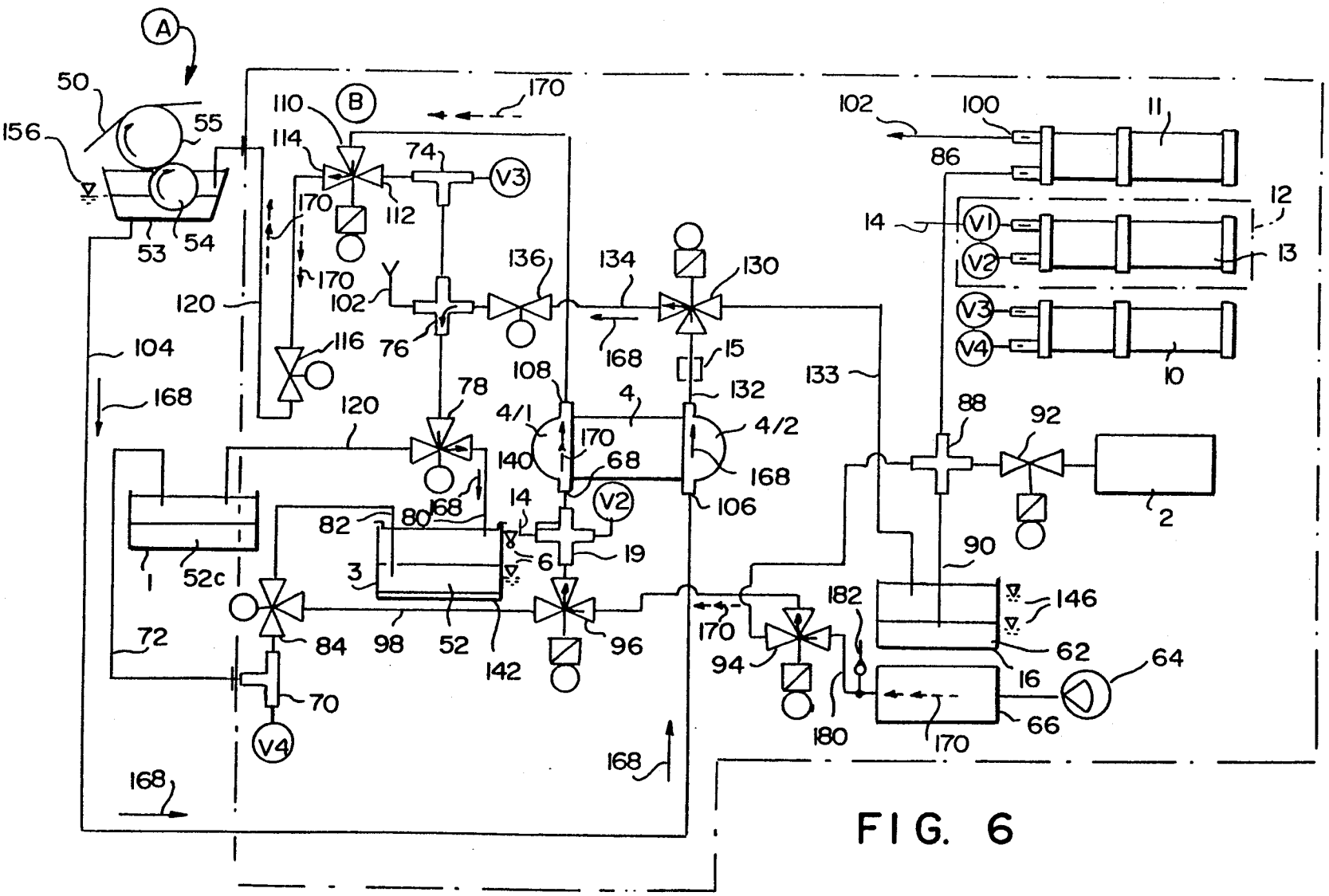
FIG. 6 is a schematized representation of the embodiment of the invention illustrated in FIG. 2 showing liquid flow and valve orientation during the commencement stage of shut down wherein the system is being drained.

Upon the termination of the operation of the coating assembly A, the liquid supply system B commences an initial drain stage of shut down which comprises draining the fluid lines of coating liquid mixture 52. With reference now to FIG. 6 wherein the flow paths for the drain stage of shut down are depicted, it will be noted that the coating liquid supply system B includes the air tank 66 supplied with air by a compressor 64. The compressed air 64 is discharged from the tank 66 along a path denoted generally by a plurality of dashed double headed arrows 170 through a compressed air line 180, a switching valve 94, the switching valve 96, the cross coupling 19, the pump 4/1, the switching valve 110, the switching valve 116 and the discharge line 120 for the purpose of clearing the Tines of coating liquid mixture 52.

Preferably, the switching valve 94, which controls the release of compressed air from the tank 66, is controlled simultaneously with one of the other switching valves in the flow path, e.g. 96 or 110 and is shut off when the end of the fluid column of coating liquid mixture is but a short distance, e.g. 2 cm, from the downstream end of the discharge line 120. By terminating compressed air flow just prior to complete evacuation of coating liquid mixture from the discharge line 120, the compressed air does not splash the coating liquid mixture carried within the applicator trough 53.

A primary significance of the initial stage of cleaning the fluid lines with compressed air is that is has the advantage of recovering coating liquid mixture carried in the fluid lines whereas, if thinner were initially used to clean the fluid lines, any coating liquid mixture in the fluid lines would be thinned to the extent that it could be no longer used in a subsequent print job. The cleaning of the liquid supply system B with thinner takes place only after the fluid has been forced from the lines by compressed air.

The measuring pump 13 evacuates the viscometer cylinder by its own pumping action and then conveys air drawn from the header through the measuring pump and its discharge line 14 at a delivery pressure generated by the measuring pump itself.

Coating liquid mixture 52, carried in the applicator trough 53, is drained along a flow path indicated by the arrows 168 and through the suction line 104 which leads into the inlet 106 of the pump 4/2, through the line 132, the filter 15, and the switching valve 130 into the line 134. From the line 134, coating liquid mixture enters the switching valve 136, the cross coupling 76 and the switching valve 70 and the discharge line 80 to collect in the holding tank 3 where it is stored.

Figure 7:
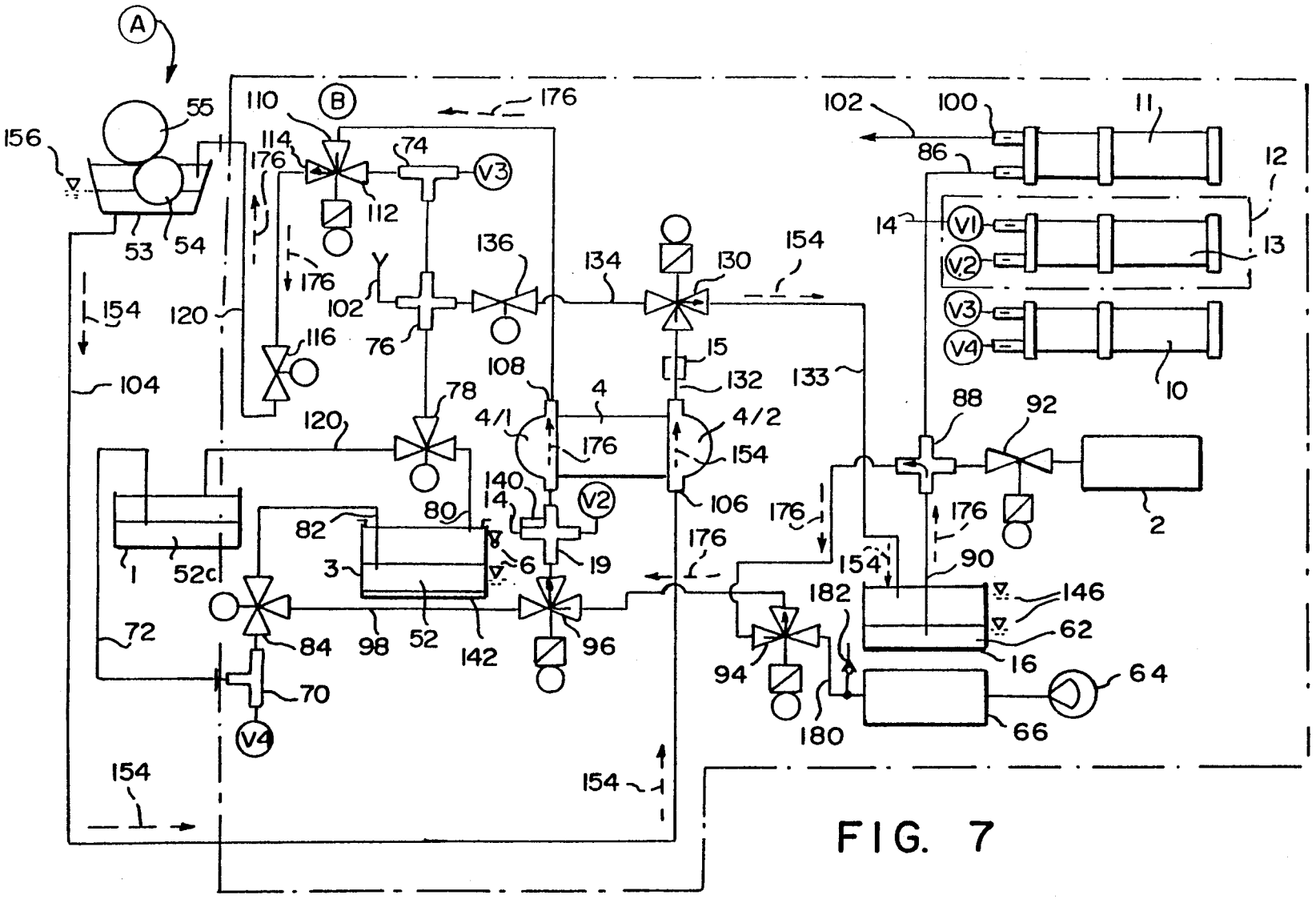
FIG. 7 is a further illustration of the embodiment depicted in FIG. 2 and showing liquid flow and valve orientation during a stage of shut down wherein the system is cleaned with liquid thinner.

Turning now to FIG. 7 wherein a further stage relating to the turn down of the system is depicted, it should be noted that after the initial draining, the thinner dosing pump 11 is turned off and the base dosing pump 10 is also turned off. The measuring pump 13 is turned on and the main pump 4 remains on. The pump 4/1 draws liquid thinner from the flush vessel 16 along a path denoted by a group of dashed arrows 176 through the cross coupling 88 and the switching valve 94 and into the switching valve 96. From the switching valve 96, thinner flows into the cross coupling 19, the inlet 68 of the pump 4/1, and the line 108 and into the switching valve 110. From the switching valve 110, thinner flows through the switching valve outlet 114, the further switching valve 116, the discharge line 120 and into the applicator trough 53.

Since the applicator trough 53 and the conduit system has been evacuated of coating liquid mixture during the preceding stage (depicted in FIG. 6), the applicator trough 53 will now contain predominantly thinner 62 and only a residue of coating liquid mixture. The thinner 62 is pumped by the pump 4/2 from the applicator trough along a flow path indicated by the dashed arrows 154 successively through the suction line 104, the pump 4/2, the filter 15, the switching valve 130, and a discharge line 133 into the flush vessel 16.

The measuring pump 13 of the viscometer draws thinner from the cross coupling 19 through its inlet V2 and discharges the thinner from its outlet V1 and line 14 back into the cross coupling 19. The thinner discharged by the measuring pump 13 is drawn by the pump 4/1 with the remaining portion of the thinner out of the cross coupling 19.

When the quantity of thinner remaining the flush vessel 16 falls below a certain value, as detected by the sensor 146, the valve 92, which connects the thinner tank 2 with the cross coupling 88, is automatically opened and thinner 62 is then pumped from the tank 2 along a flow path marked by the dashed arrows 176 through the switching valve 92, the cross coupling 88, the switching valve 94, the switching valve 96, the cross coupling 19, the pump 4/1, the line 108, the switching valve 110, the switching valve 116 and the discharge line 120 into the applicator trough 53 and thence along the flow path marked by the dashed arrows 154 into the flush vessel 16. In this manner, a clear flush of pure thinner within the conduit system is automatically effected.

Figure 8:
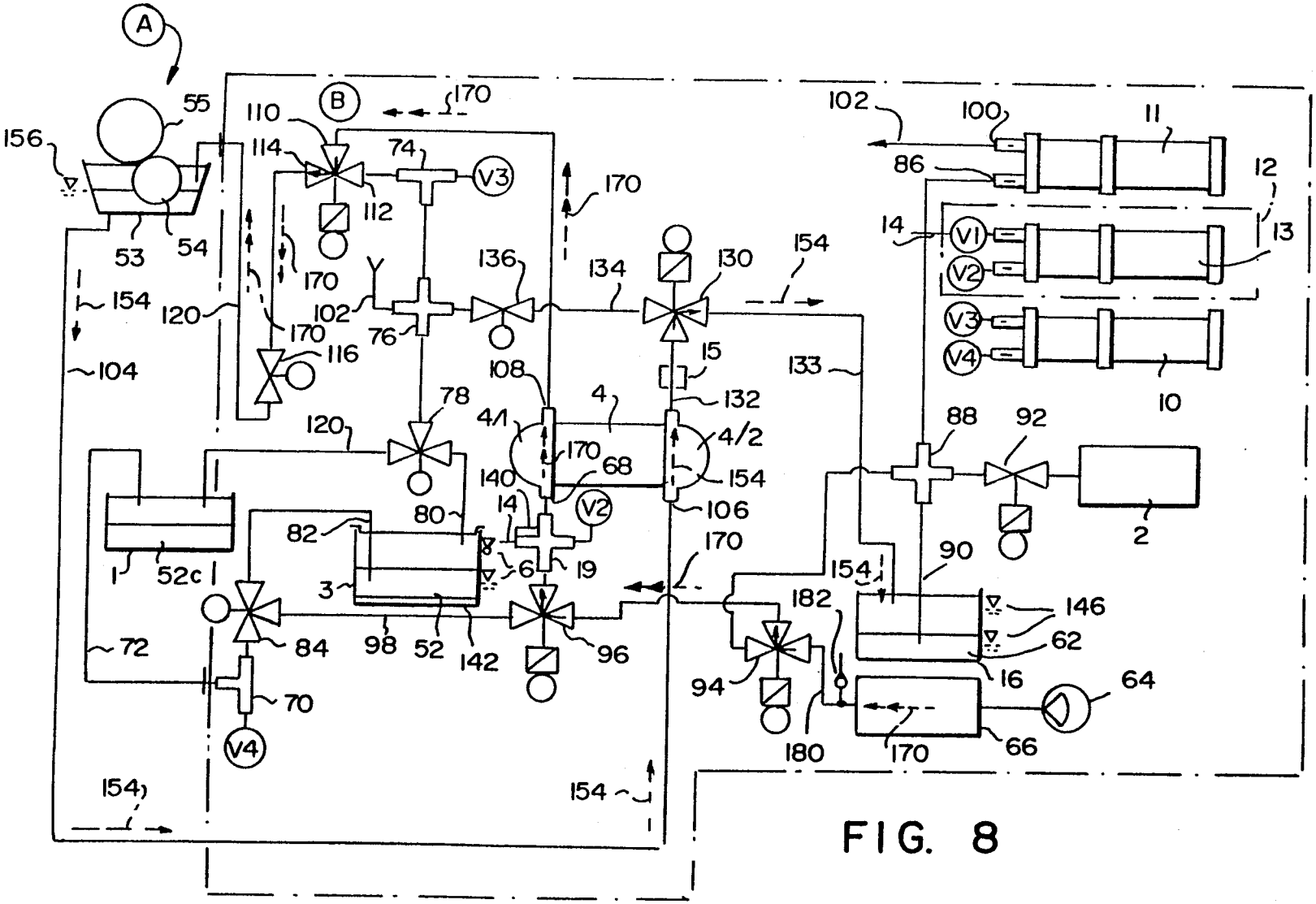
FIG. 8 is a further illustration of the embodiment of the invention depicted in FIG. 2 and showing valve orientation and fluid flow during a final stage of shut down comprising an air purge cycle.

The final stage of shutdown of the liquid supply system is depicted in FIG. 8 wherein fluid flow and valve orientation for the evacuation and purging of thinner from the conduit system is depicted. In this stage, the coating liquid base dosing pump 10 and the thinner dosing pump 11 are turned off and the viscometer measuring pump 13 may be either on or off but is preferably on so that it too, may be purged with air.

Compressed air from the tank 66 flows along a path indicated by the dashed double arrows 170 through the line 180, the switching valves 94, 96, the cross coupling 19, the inlet 68 of the pump 4/1 (which remains on) and through the line 108, the switching valve 110, the switching valve 116 and the discharge line 120. The compressed air supply is turned off again, preferably simultaneously with one of the switching valves, just prior to the end of the thinner column being discharged at the end of the discharge line 120 so that compressed air will not blow thinner out of the applicator trough.

The pump 4/2 draws thinner from the applicator trough 53 along a flow path denoted by the dashed arrow 154 through the suction line 104, the inlet 106 of the pump 4/2, the pump 4/2, the filter 15, the switching valve 130 and the discharge line 133 into the flush vessel 16. A check valve 182 which opens in the presence of a vacuum is positioned in the compressed air flow line 180, to eliminate a vacuum against which the pump 4/1 would otherwise operate after the compressed air supply has been turned off and while the pump 4/2 is operating for the purpose of draining the thinner out of the applicator trough.

After the final air purge and thinner draining operations, the liquid supply system B is ready for subsequent use and a recycling of operation stages commencing with that depicted in FIG. 3.

It should be appreciated that with respect to the flow paths and switchings valve orientation as depicted in FIGS. 3 through 8, valves and switching valves are open only in the flow direction indicated by the arrows superimposed on such valves and all valves and switching valves for which no flow path is indicated by arrows are closed. Additionally, it should be noted that all valves may be proportionally opened or closed to any desired degree so that they may be employed as a flow control device rather than as only a flow interruption device.

With attention again directed to FIG. 2, a further mode of operation of the liquid supply system B will now be considered. It is possible, in some coating applications, that no thinner be utilized, i.e. that the coating assembly A deposits a coating of only undiluted coating liquid base **52*c* or any other coating liquid carried in the tank 1. In such instances, the switching valves of the liquid supply system are configured to provide a liquid flow path from the tank 1 to the applicator trough 53 and from the applicator trough 53 directly back to the tank 1**.

Coating liquid base **52*c* or any other coating liquid carried in the tank 1 will flow from the tank 1 through the suction line 72, the T coupling 70, the switching valve 84 and through the line 98. From the line 98, flow continues through the switching valve 96, the cross coupling 19, the pump inlet 68, the pump 4/1, the pump outlet 108 and the further switching valve 110. Flow continues through the outlet 114 of switching valve 112, the further switching valve 116 and the discharge line 120 into the applicator trough 53**.

Coating liquid base **52*c* or other coating liquid which has been pumped into the applicator trough 53 is drawn from the trough along the suction line 104 into the inlet 106 of the pump 4/2, and from the pump 4/2 into the line 132 and the filter 15 to the switching valve 130. The switching valve 130 is configured to direct flow into the line 134, then through the switching valve 136 and the coupling 76 to the switching valve 78. The switching valve 78 directs flow into a discharge line 122 which returns the coating liquid base back into the tank 1**.

Thus it will be seen that there is provided a recirculating coating liquid supply system which achieves the various aspects, features and considerations of the present invention and which is well adapted to meet the conditions of practical usage.

Various possible embodiments might be made of the present invention or various changes might be made of the exemplary embodiments set forth herein without departing from the spirit of the invention, it is to be understood that all matters shown and described in the accompanying drawings are to be interpreted as illustrative and not in a limiting sense.

Having thus described the invention, there is claimed as new and desired to be secured by Letters Patent:

1. A recirculating coating liquid supply system for continuous delivery of a supply of coating liquid to a coating apparatus, the coating liquid comprising a mixture of coating liquid base and coating liquid thinner, the supply system comprising a holding tank for coating liquid mixture, an applicator trough associated with the coating apparatus and conduit means for circulating coating liquid mixture from the holding tank to the applicator trough and from the applicator trough back to the holding tank, the conduit means including a main feed line having an inlet at the holding tank and two branches, a first branch having an outlet at the applicator trough and a second branch having an outlet at the holding tank, the conduit means further including a return feed line having an inlet at the applicator trough and an outlet at the holding tank, a pump positioned in the main feed line, the pump dividing the main feed line into an upstream section and a downstream section, a viscometer, means operatively connecting the viscometer to the main feed line for measurement of the viscosity of coating liquid mixture flowing through the main feed line, a coating liquid base tank for carrying a quantity of coating liquid base, means for infusing a quantity of coating liquid base from the coating liquid base tank into the main feed line for adjustment of the viscosity of coating liquid mixture flowing through the main feed line, a coating liquid thinner supply, and means for infusing a quantity of coating liquid thinner from the coating liquid thinner supply into the main feed line for adjustment of the viscosity of coating liquid mixture flowing through the main feed line.

2. A recirculating coating liquid supply system constructed in accordance with claim 1 further including a valve positioned in the first branch of the main feed line whereby the valve may be actuated so that the main feed line recirculates and mixes coating liquid mixture without delivering coating liquid mixture to the applicator trough.

3. A recirculating coating liquid supply system as constructed in accordance with claim 1 wherein the means for infusing a quantity of coating liquid base into the main feed line includes dosing pump.

4. A recirculating coating liquid supply system as constructed in accordance with claim 1 wherein the means for infusing a quantity of coating liquid thinner from the coating liquid thinner supply into the main feed line comprises a dosing pump.

5. A recirculating coating liquid supply system as constructed in accordance with claim 1 wherein the means for infusing coating liquid base and the means for infusing coating liquid thinner are connected to the main feed line on the downstream side of the pump.

6. A recirculating coating liquid supply system as constructed in accordance with claim 1 further including a line interconnecting the coating liquid base tank and the upstream side of the main feed line, a first valve operatively positioned to open and close the interconnecting line and a second valve operatively positioned to selectively open and close the upstream side of the main feed line between the holding tank and the interconnecting line whereby the first valve can be opened and the second valve can be closed for the purpose of pumping a quantity of coating liquid base into the holding tank upon initial startup and thereafter, the first valve closed and the second valve opened for mixing and recirculation of coating liquid mixture.

7. A recirculating coating liquid supply system as constructed in accordance with claim 1 further including an agitator blade in the holding tank, the blade being configured to rotate as a result of rebound flow within the holding tank.

8. A recirculating coating liquid supply system for continuous delivery of a supply of coating liquid to a coating apparatus, the coating liquid comprising a mixture of coating liquid base and coating liquid thinner, the supply system comprising a holding tank for the coating liquid mixture, an applicator trough associated with the coating apparatus, conduit means for circulating coating liquid mixture from the holding tank to the applicator trough and from the applicator trough back to the holding tank, the conduit means including a main feed line having an inlet at the holding tank and an outlet at the applicator trough and a return feed line having an inlet at the applicator trough and an outlet at the holding tank, a main pump positioned in the main feed line, the main pump dividing the main feed line into an upstream section and a downstream section, a viscometer, means operatively connecting the viscometer to the upstream section of the main feed line, a coating liquid base tank, the coating liquid base tank carrying a supply of coating liquid base, a line connecting the coating liquid base tank with the downstream section of the main feed line, a dosing pump operatively connected to the line connecting the coating liquid base tank with the downstream section of the main feed line for introducing a measured quantity of coating liquid base to the liquid coating mixture flowing through the main feed line for adjustment of its viscosity, a supply of coating liquid thinner, a line interconnecting the coating liquid thinner supply with the downstream section of the main feed line and a dosing pump operatively connected to the line interconnecting the coating liquid thinner supply with the downstream section of the main feed line for introducing a measured quantity of coating liquid thinner into the main feed line for adjustment of the viscosity of the coating liquid mixture flowing through the main feed line.

9. A recirculating coating liquid supply system as constructed in accordance with claim 8 further including a pump in the return feed line, the pump in the main feed line and the pump in the return feed line comprising separate delivery chambers of a dual chamber diaphragm pump.

10. A recirculating coating liquid supply system as constructed in accordance with claim 8 further including a valve operatively connected to the main feed line for selectively blocking flow to the outlet at the applicator trough, the main feed line further including a branch line having an outlet at the holding tank and a valve operatively connected to the branch line for selectively coupling the branch line with the downstream section of the main feed line whereby the main feed line may be utilized for mixing coating liquid mixture by recirculating coating liquid mixture out of and into the holding tank prior to delivery of coating liquid mixture to the applicator trough.

11. A recirculating coating liquid supply system as constructed in accordance with claim 8 further including a flush vessel, the flush vessel for carrying coating liquid thinner, and means selectively coupling the coating liquid thinner within the flush vessel to the upstream section of the main feed line, the thinner being drawn by the main pump and forced through the downstream section of the main feed line into the applicator trough.

12. A recirculating coating liquid supply system as constructed in accordance with claim 11 further including means selectively coupling the return line with the applicator trough, whereby thinner collected in the flush vessel is drawn through the return line and redeposited in the flush vessel.

13. A recirculating coating liquid supply system as constructed in accordance with claim 8 further including a supply of compressed air, means selectively coupling the supply of compressed air with the upstream section of the main feed line, the compressed air being employed to purge the main feed line of coating liquid mixture.

14. A recirculating coating liquid supply system as constructed in accordance with claim 1 wherein the pump is positioned in the main feed line before the main feed splits into the first and second branch, the first branch and the second branch being positioned within the downstream section of the main feed line.

15. A recirculating coating liquid thinner supply system as constructed in accordance with claim 1, further including a coating liquid thinner tank, the coating liquid thinner supply being carried in the coating liquid thinner tank.

16. A recirculating coating liquid supply system for continuous delivery of a supply of coating liquid to a coating apparatus, the coating liquid comprising a mixture of coating liquid base and coating liquid thinner, the supply system comprising a holding tank for the coating liquid mixture, an applicator trough associated with the coating apparatus, conduit means for recirculating coating liquid mixture from the holding tank to the applicator trough and from the applicator trough back to the holding tank, the conduit means including a main feed line having an inlet at the holding tank and an outlet at the applicator trough, the conduit means further including a return feed line having an inlet at the applicator trough and an outlet at the holding tank, the supply system further including a supply of compressed air, and means for expelling coating liquid from the main feed line into the applicator trough, the means for expelling including means for operatively connecting the supply of compressed air to the main feed line for the introduction of compressed air into the main feed line, means for draining the expelled coating liquid mixture from the applicator trough, means operatively connected to the means for draining for collecting the drained coating liquid mixture, a coating liquid thinner supply, and means for selectively interconnecting the coating liquid thinner supply with the main feed line for flushing the main feed line with coating liquid thinner, the applicator trough including means for collecting the coating liquid thinner flushed through the main line, the supply system further including means for draining the applicator trough of coating liquid thinner and means for collecting the drained coating liquid thinner.

17. A recirculating coating liquid supply system as constructed in accordance with claim 16 wherein the means for collecting the drained coating liquid mixture comprises a holding tank and the means for collecting the drained coating liquid thinner comprises a flush vessel.

18. A method of cleaning a recirculating coating liquid supply system constructed in accordance with claim 16, the method comprising the steps of:

(a) expelling coating liquid mixture from the main feed line into the applicator trough by introducing compound compressed air into the main feed line;
(b) collecting the expelled coating liquid mixture in the applicator trough;
(c) draining the applicator trough of coating liquid mixture;
(d) collecting the drained coating liquid mixture;
(e) flushing the main feed line with coating liquid thinner;
(f) collecting the coating liquid thinner employed to flush the main feed line in the applicator trough;
(g) draining the applicator trough of coating liquid thinner; and
(h) collecting the coating liquid thinner drained from the applicator trough.

19. A recirculating coating liquid supply system as constructed in accordance with claim 12 further including a supply of compressed air, means selectively coupling the supply of compressed air with the upstream section of the main feed line, the compressed air being employed to purge the main feed line of coating liquid mixture.

20. A method of cleaning a recirculating liquid coating supply system constructed in accordance with claim 19, the method comprising the steps of:

(a) expelling coating liquid mixture from the main feed line into the applicator trough by introducing compressed air into the main feed line;
(b) collecting the expelled coating liquid mixture in the applicator trough;
(c) draining the applicator trough of coating liquid mixture;
(d) collecting the coating liquid mixture drained from the applicator trough;
(e) flushing the main feed line with coating liquid thinner;
(f) collecting the coating liquid thinner employed to flush the main feed line in the applicator trough;
(g) draining the applicator trough of coating liquid thinner; and
(h) collecting the coating liquid thinner drained from the applicator trough.

* * * * *